US006588642B1

(12) United States Patent
Wang et al.

(10) Patent No.: US 6,588,642 B1
(45) Date of Patent: Jul. 8, 2003

(54) SINGLE AND AUTOMATIC TRIGGER DEVICE FOR STAPLERS

(75) Inventors: Zhong-Jun Wang, Taichung (TW); Jun-Ji Lai, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 10/306,554

(22) Filed: Nov. 26, 2002

(51) Int. Cl.[7] ..... B25C 1/04
(52) U.S. Cl. ..... 227/8; 227/130
(58) Field of Search ..... 227/130, 8, 142

(56) References Cited

U.S. PATENT DOCUMENTS 5,551,621 A * 9/1996 Vallee ..... 227/130
5,667,127 A * 9/1997 Ichikawa et al. ..... 227/8
5,669,541 A * 9/1997 Ronconi ..... 227/130
5,785,227 A * 7/1998 Akiba ..... 227/8
5,791,545 A * 8/1998 Lin ..... 227/8
5,836,501 A * 11/1998 Lai ..... 227/130
6,116,488 A * 9/2000 Lee ..... 227/8
6,422,446 B1 * 7/2002 Liu ..... 227/8

* cited by examiner

*Primary Examiner*—Scott A. Smith
(74) *Attorney, Agent, or Firm*—Charles E. Baxley

(57) ABSTRACT

A trigger device for staplers includes a trigger pivotably connected to a stapler body and an opening is defined through the trigger. A cam device is rotatably engaged with the trigger and a lower end of an activating member is connected to the cam device so that the activating member is moved up and down by rotating the cam device. A safety plate is slidably connected to the stapler body and a distal end of the safety plate is located in correspondence with the opening of the trigger.

3 Claims, 16 Drawing Sheets

SINGLE AND AUTOMATIC TRIGGER DEVICE FOR STAPLERS

FIELD OF THE INVENTION

The present invention relates to a trigger device which has an adjustable device for shifting single and automatic function of a stapler.

BACKGROUND OF THE INVENTION

A conventional trigger device of a stapler is shown in FIGS. 1 and 2 and generally includes a trigger 11 pivotally connected to the body of the stapler 10 and an activating member 12 as shown in FIG. 2 is located at the back of the trigger 11. The trigger 11 has an opening 15 defined therethrough and an activating member 12 has a recess 16 defined in a top thereof. A safety plate 14 is movably connected to the stapler and has a tongue 140 which extends in the opening 15 and located in correspondence with the recess 16 of the activating member 12 so that if the trigger is pulled before the safety plate 14 is pushed, there will be no action for the valve member 13. The safety plate 14 has to be pushed to let the tongue 140 push the activating member 12 to push the spring 130 and the activating member 12 is pivoted toward the valve member 13 of the stapler 10. After the safety plate 14 is pushed, the valve member 13 is pushed by the activating member 12 which is pushed by the trigger 11. Nevertheless, the conventional trigger device can only eject the staples one by one and cannot make an automatic stapling.

The present invention intends to provide a trigger device that has an adjustable device for shifting single shooting into automatic shooting.

SUMMARY OF THE INVENTION

In accordance with one aspect of the present invention, there is provided a trigger device for staplers and the trigger device comprises a trigger pivotably connected to a stapler body and an opening is defined through the trigger. A cam device is rotatably engaged with the trigger and connected to an activating member inserted in the opening of the trigger. A top plate extends at an angle from the activating member and the activating member is movable upward and downward by rotating the cam device. A safety plate is slidably connected to the stapler body and a distal end of the safety plate is located in correspondence with the opening of the trigger.

The primary object of the present invention is to provide a trigger device for a stapler which has a cam device to move the activating member to change the corresponding position between the safety plate and the activating member so as to switch single shooting and automatic shooting functions.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
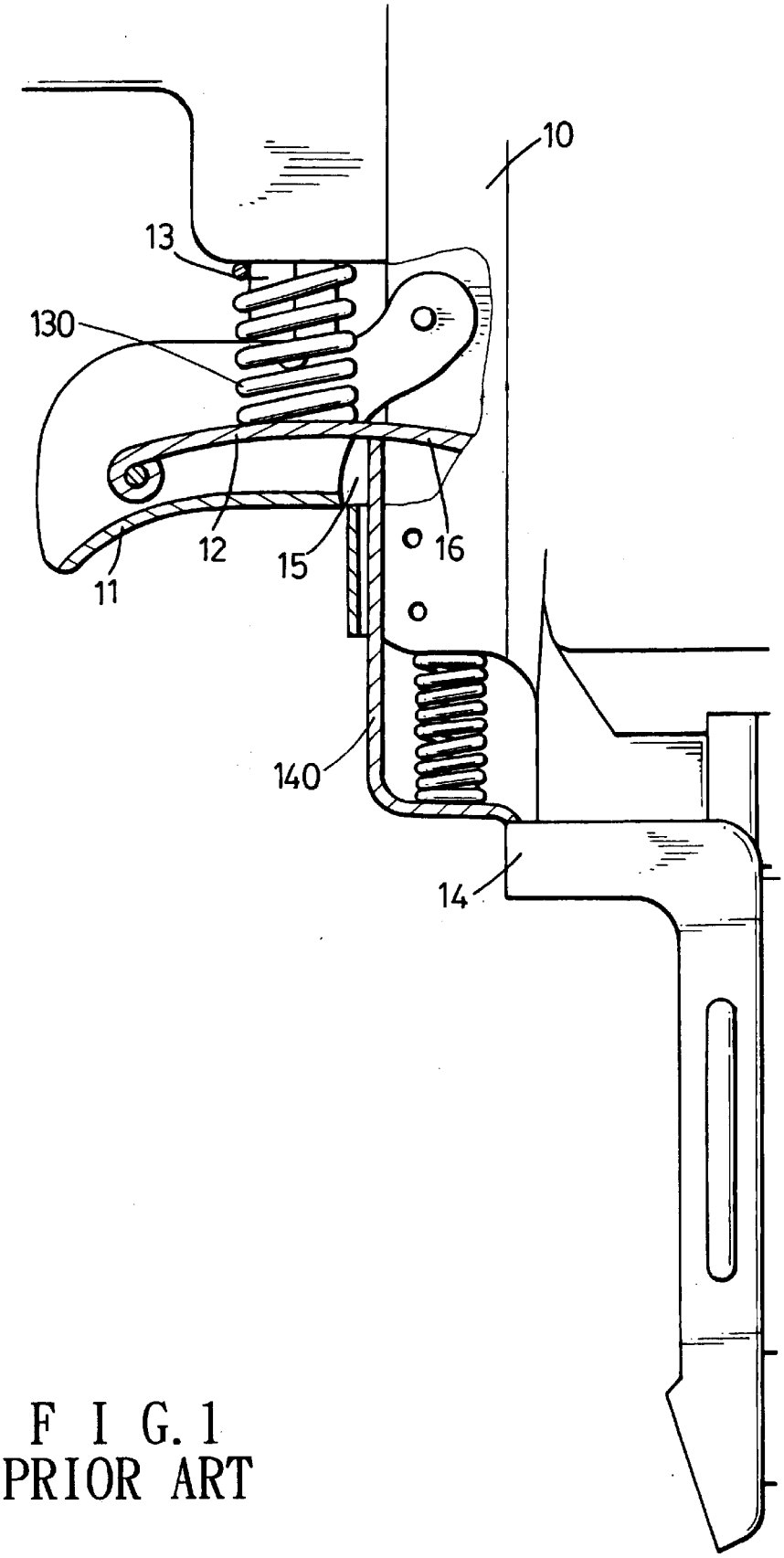
F I G. 1 PRIOR ART
FIG. 1 shows the conventional trigger device of staplers.
Figure 2:
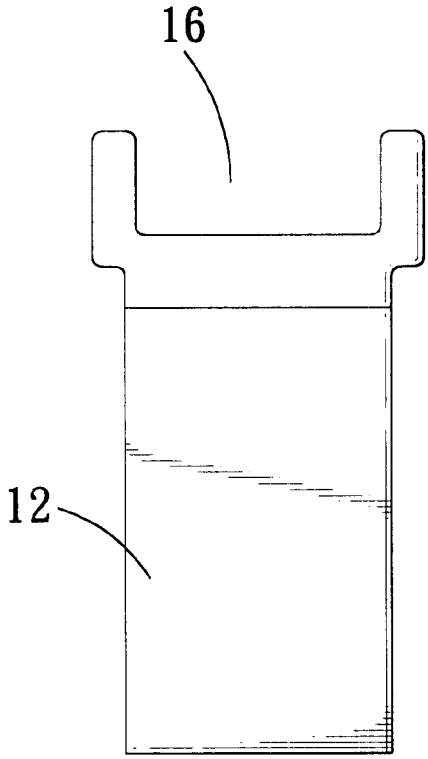
F I G. 2 PRIOR ART
FIG. 2 shows the activating member of the conventional trigger device.
Figure 3:
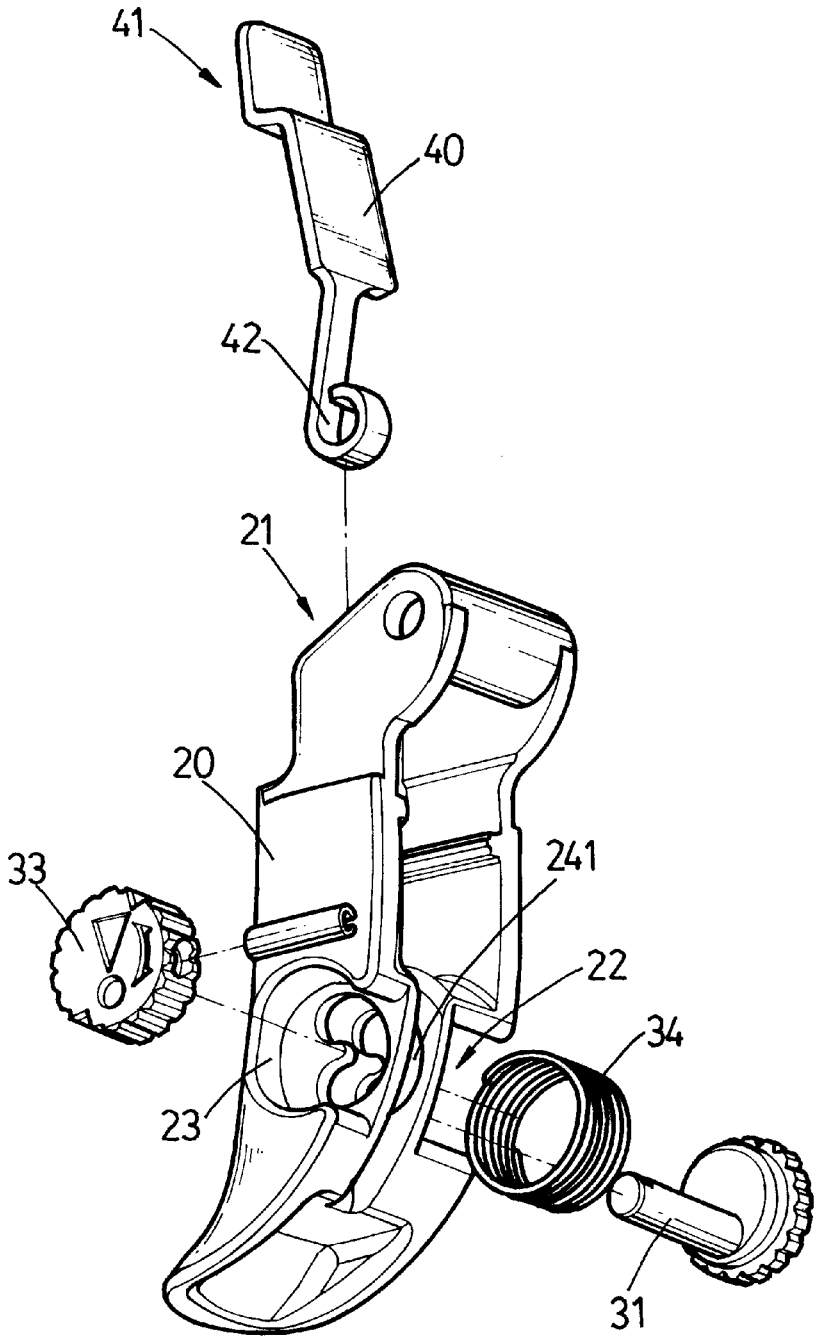
FIG. 3 is an exploded view to show the trigger device of the present invention.
Figure 4:
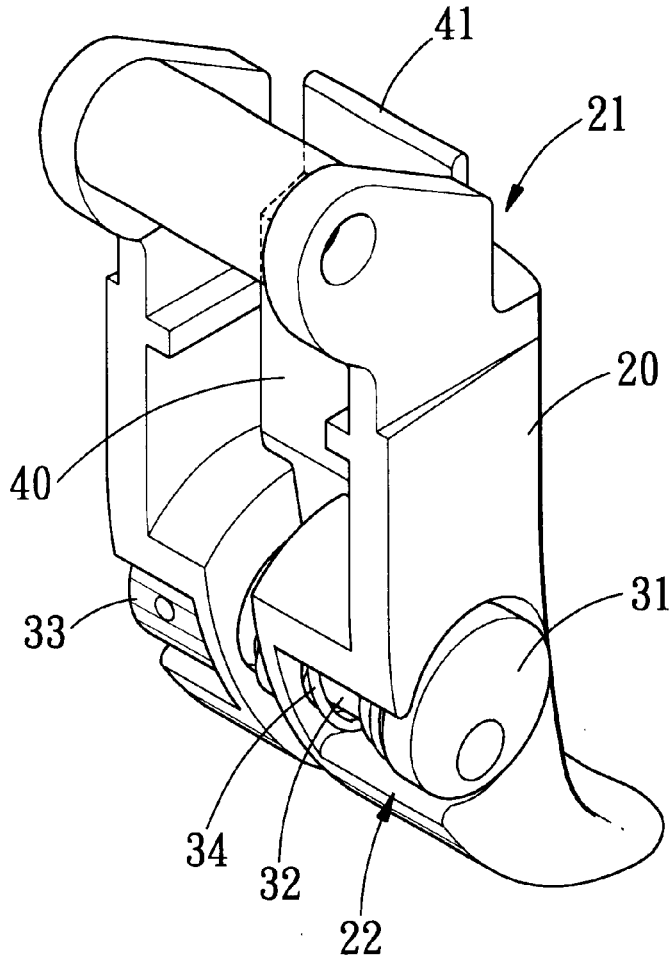
FIG. 4 is a perspective view to show the trigger device of the present invention.

Referring to FIGS. 3, 4, 8 and 10, the trigger device for a stapler of the present invention comprises a trigger 20 pivotably connected to a stapler body 50 and an opening 21 defined through the trigger 20. A valve member 51 is located behind the trigger 20. The trigger 20 includes two sidewalls and a first recess 22 and a second recess 23 are defined in two opposite walls of the trigger 20. A passage 241 is defined in communication with the first recess 22 and the second recess 23.

A cam device is rotatably engaged with the trigger 20 and includes a plate 31 received in the first recess 22 and a knob 33 rotatably received in the second recess 23. A rod 32 extends eccentrically from the plate 31 and through the passage 241 and is engaged with a notch defined eccentrically in the knob 33. A spring 34 is mounted to the rod 32 and biased between the plate 31 and an inside of the first recess 22.

Figure 10:
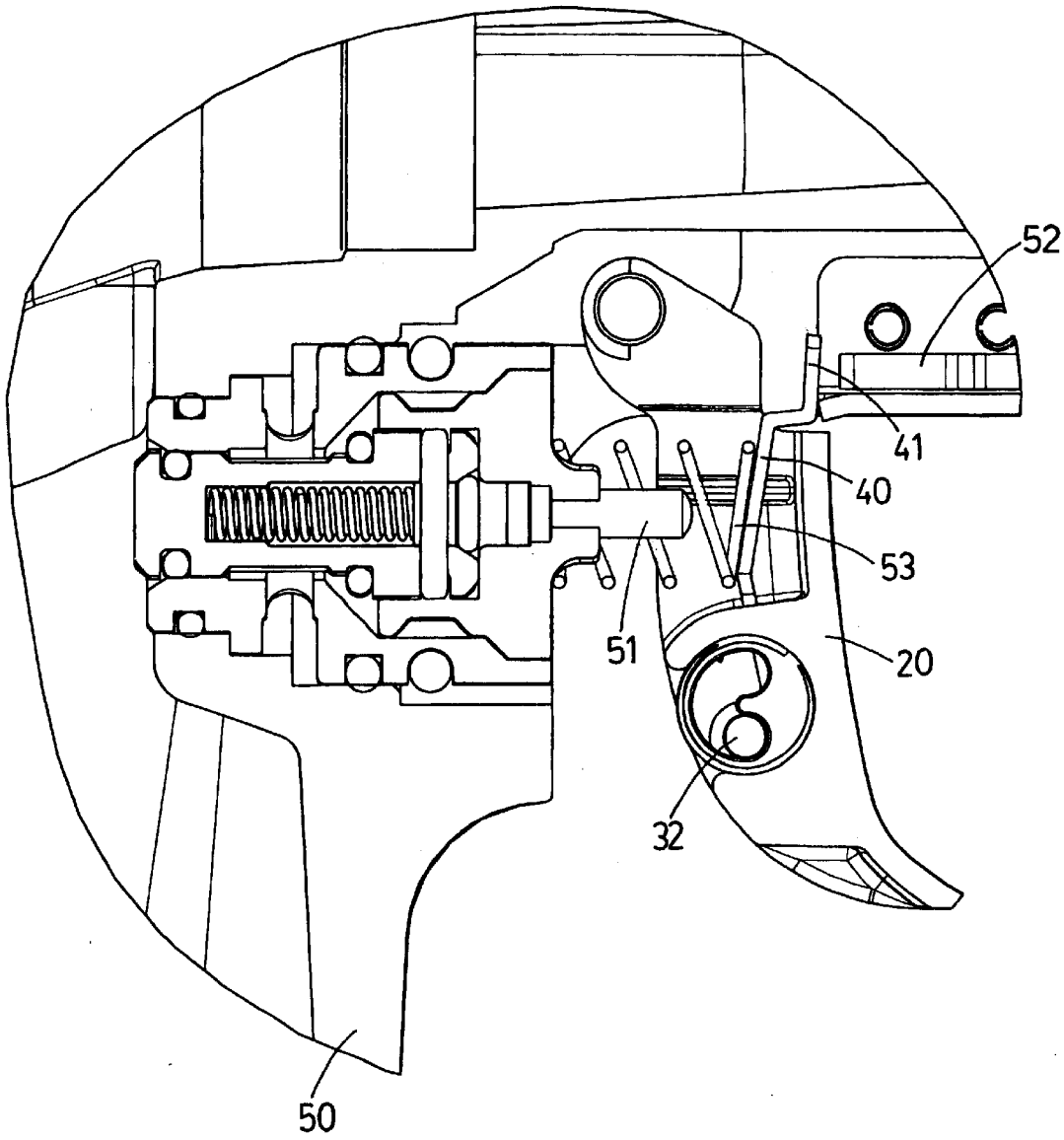
FIG. 10 shows the trigger and the safety plate at the normal position.

An activating member 40 is inserted in the opening 21 and has a ring 42 at the lower end of the activating member 40. The rod 32 extends through the ring 42 and a top plate 41 extends at an angle from the activating member 40. The activating member 40 is able to be movable upward and downward by rotating the knob 33. A spring 53 is mounted to the valve member 51 and biased against the back of the activating member 40 as shown in FIG. 10.

A safety plate 52 is slidably connected to the stapler body 50 and a distal end of the safety plate 52 is located in correspondence with the opening 21 of the trigger 20.

Figure 5:
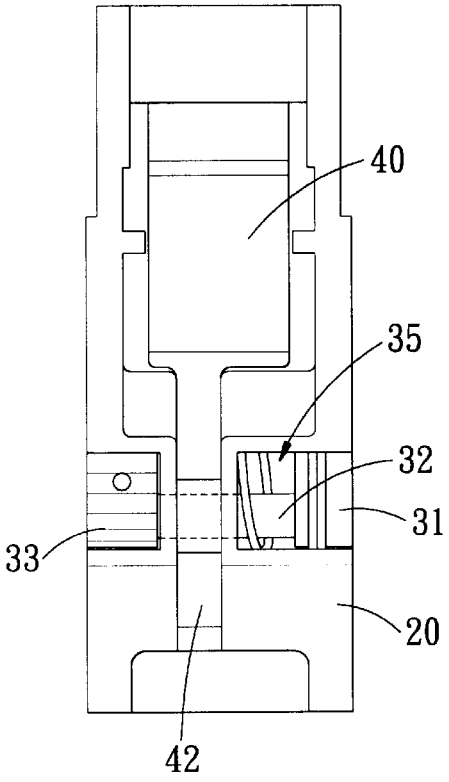
FIG. 5 is a plan view to show the trigger device of the present invention.
Figure 6:
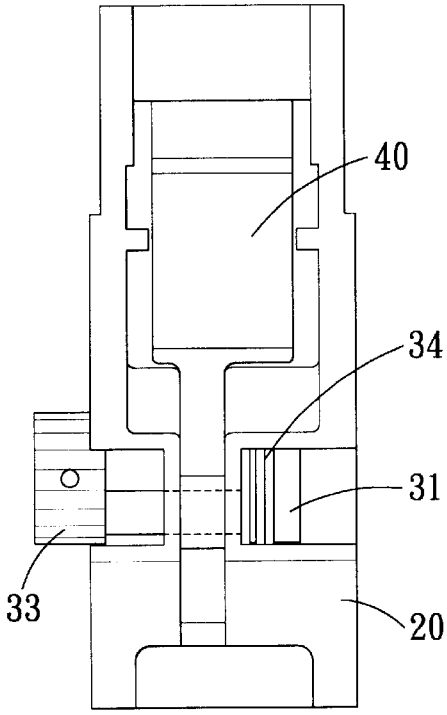
FIG. 6 shows that the knob is pulled out to rotate the cam device of the trigger device of the present invention.
Figure 7:
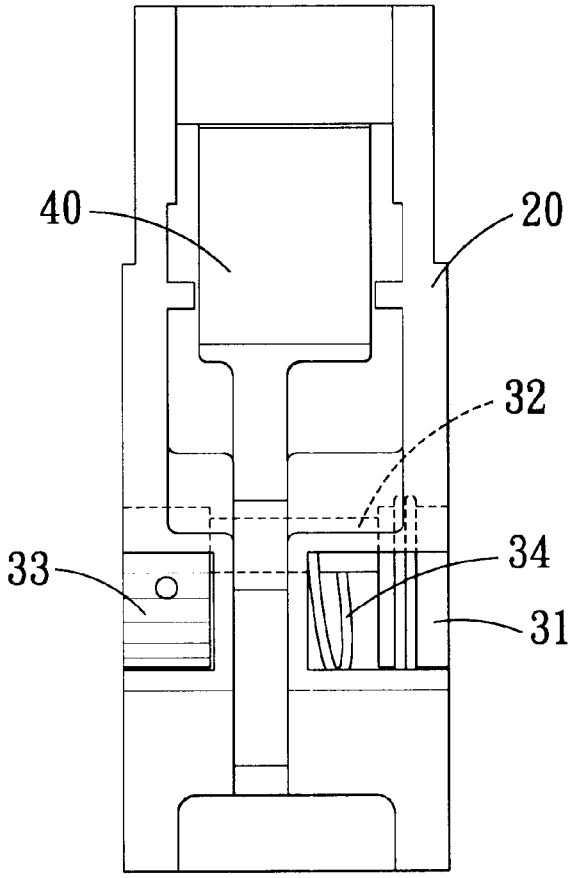
FIG. 7 shows that the activating member is raised to a high position.
Figure 8:
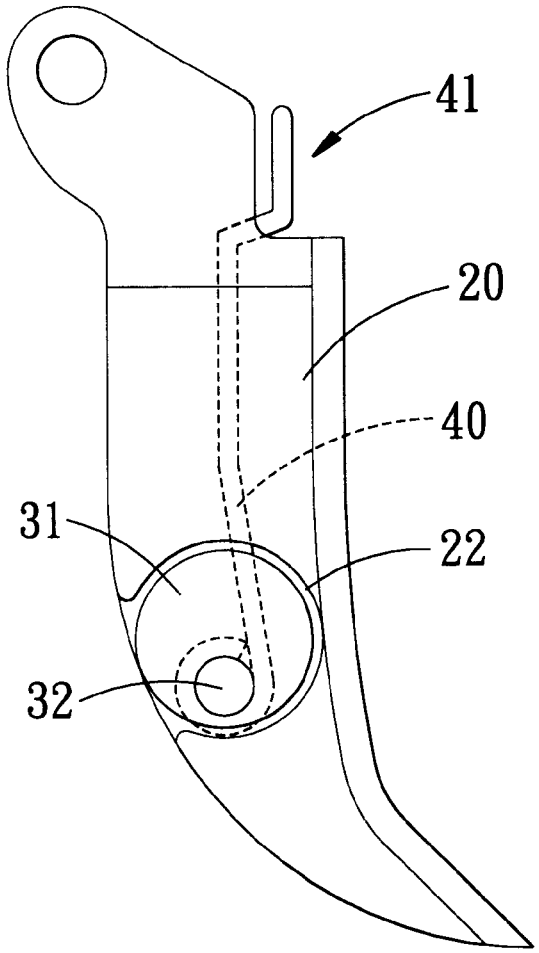
FIG. 8 shows the low position of the activating member in the trigger.
Figure 9:
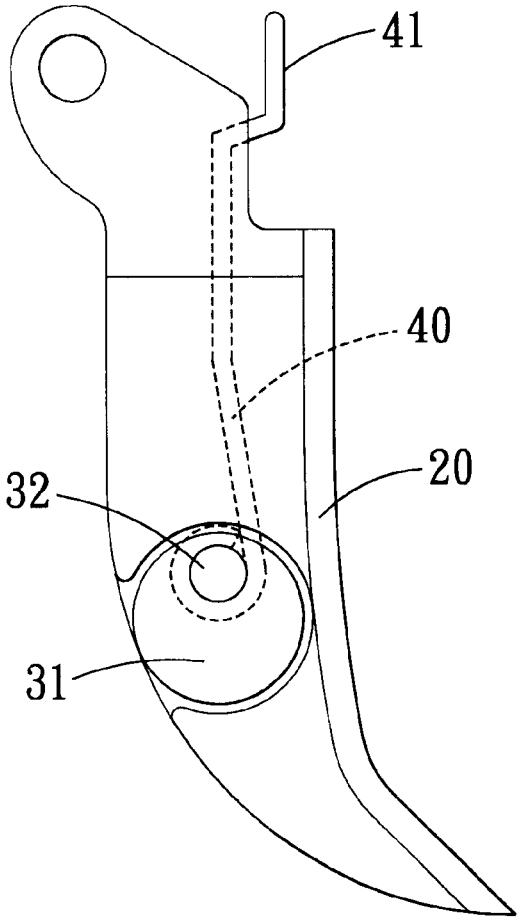
FIG. 9 shows the high position of the activating member in the trigger.

As shown in FIGS. 5 and 6, when moving the activating member 40, the plate 31 is firstly pushed to compress the spring 34 and the knob 33 then protrudes out from the second recess 23. The user may rotate the knob 33 to raise the rod 32 which pushes the activating member 40 upward as shown in FIGS. 7 and 9.

Figure 11:
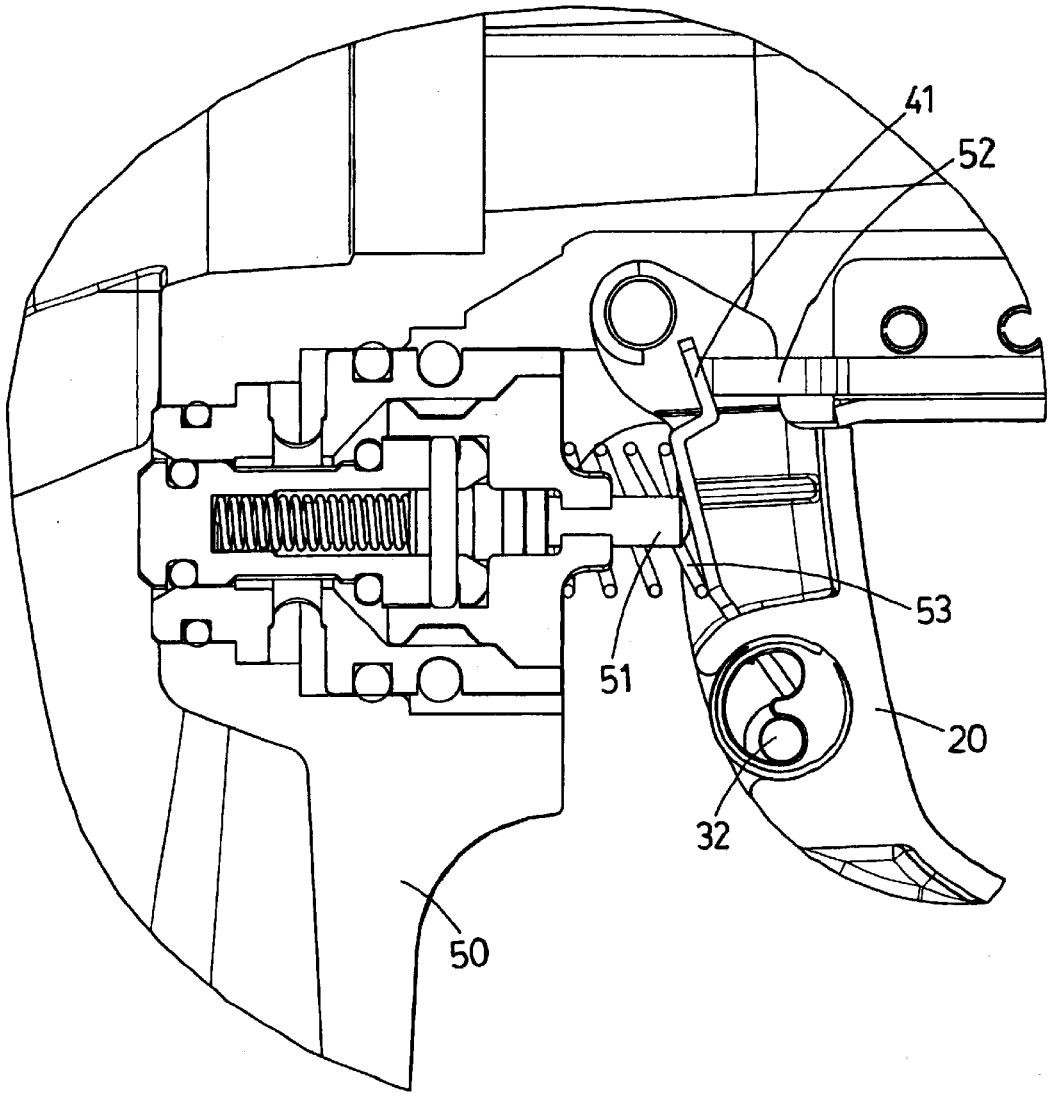
FIG. 11 shows the activating plate is pushed by the safety plate.
Figure 12:
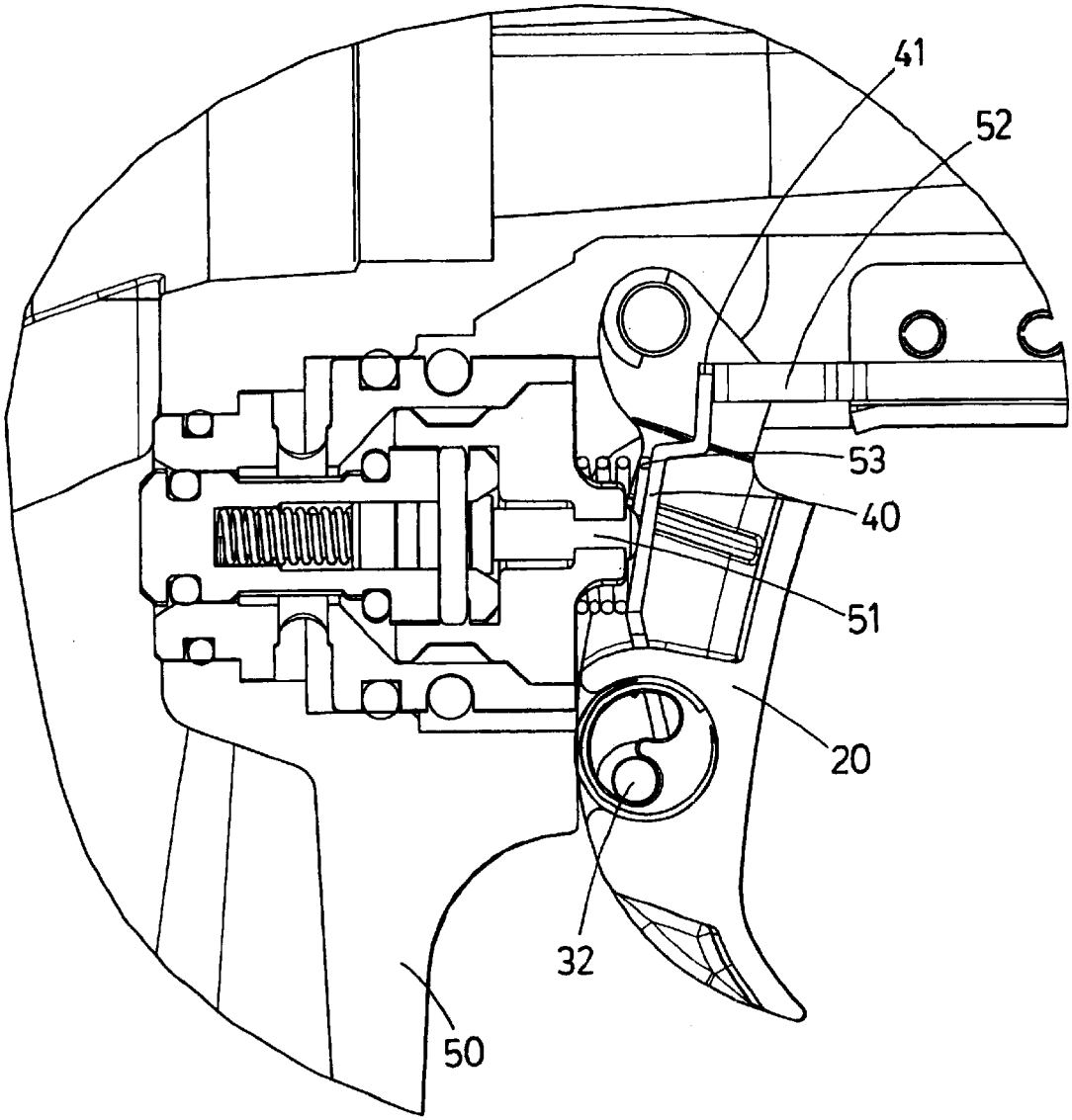
FIG. 12 shows the trigger is pulled to activate the valve member.
Figure 13:
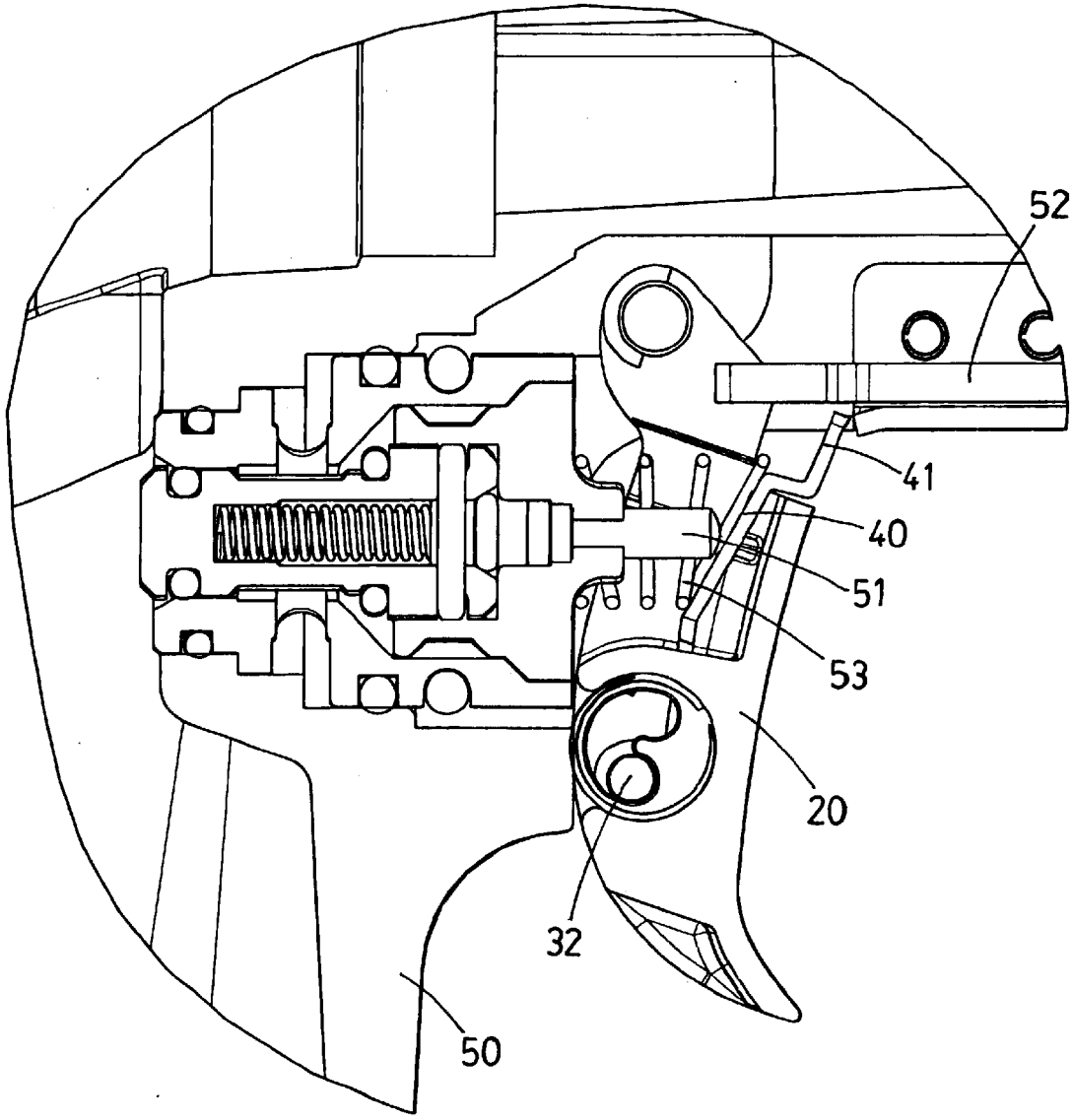
FIG. 13 shows when the trigger is pulled before the safety plate is pushed.

As shown in FIGS. 11 and 12, before shooting, the safety plate 52 is pushed to extend through the opening 21 of the trigger 20 and pushes the top plate 41 backward. The activating member 40 then compresses the spring 53 and located in front of the valve member 51. The trigger 20 is then pulled and the activating member 40 pushes the valve member 51 to shoot a staple. After shooting, the top plate 41 is moved away from the safety plate 52 and is then pushed back to pass below the safety plate 52 as shown in FIG. 13. In this situation, the valve member 51 cannot be pushed by trigging the trigger 20.

Figure 14:
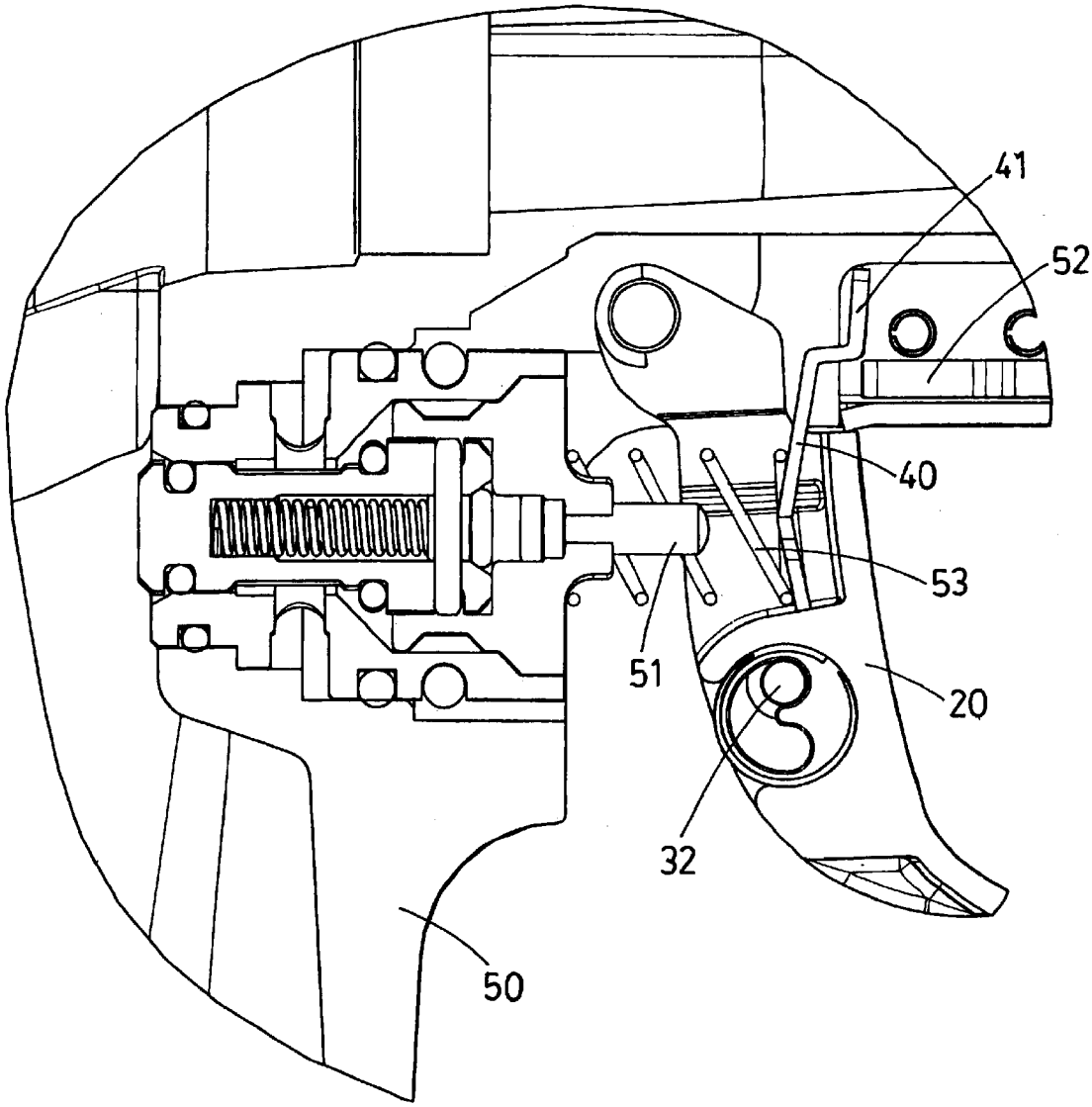
FIG. 14 shows the activating member is raised to a high position.
Figure 15:
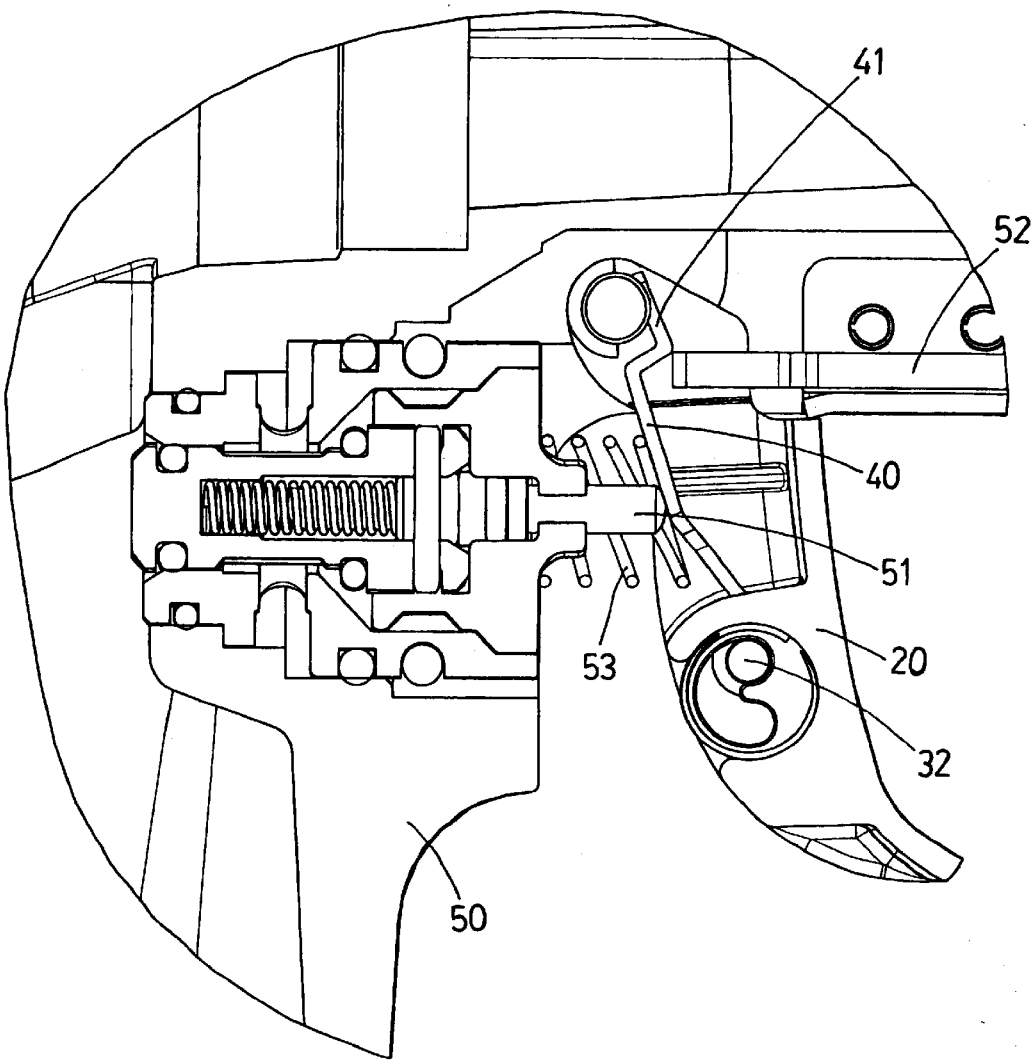
FIG. 15 shows the safety plate is pushed when the activating member is raised to a high position.
Figure 17:
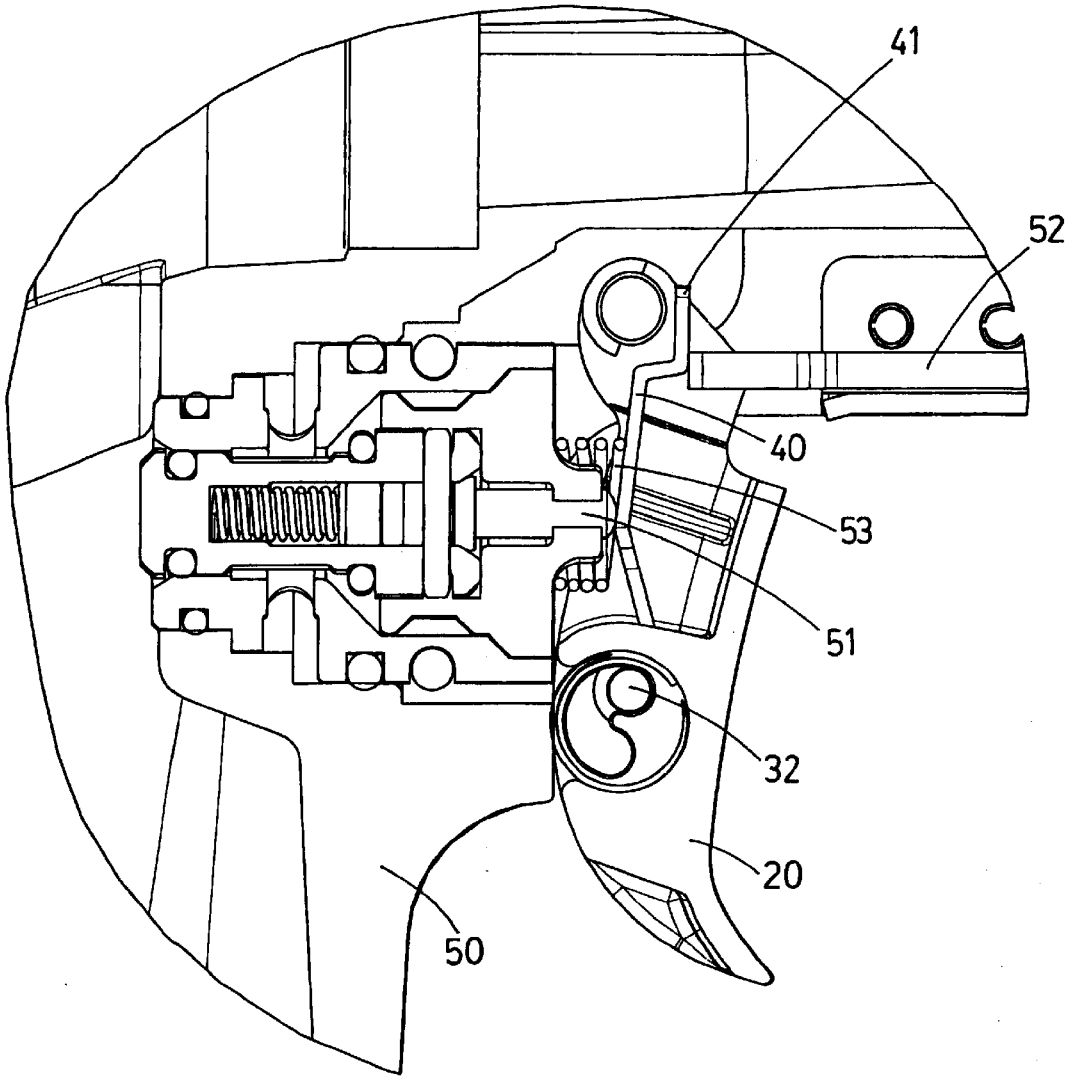
FIG. 17 shows the safety plate is pushed to push the activating member and the trigger is pulled to automatically shoot.

If the stapler is to be shoot automatically, as shown in FIGS. 14 and 15, when the activating member 40 is raised to a high position by rotating the knob 33, the lower edge of the top plate 41 is located to be pushed by the safety plate 52 as shown in FIG. 15. The trigger 20 is then pulled as shown in FIG. 17, the valve member 51 is pushed and the activating member 40 does not move pass the safety plate 52 so that the valve member 51 can be held at the shooting position and the staples are shot continuously.

Figure 16:
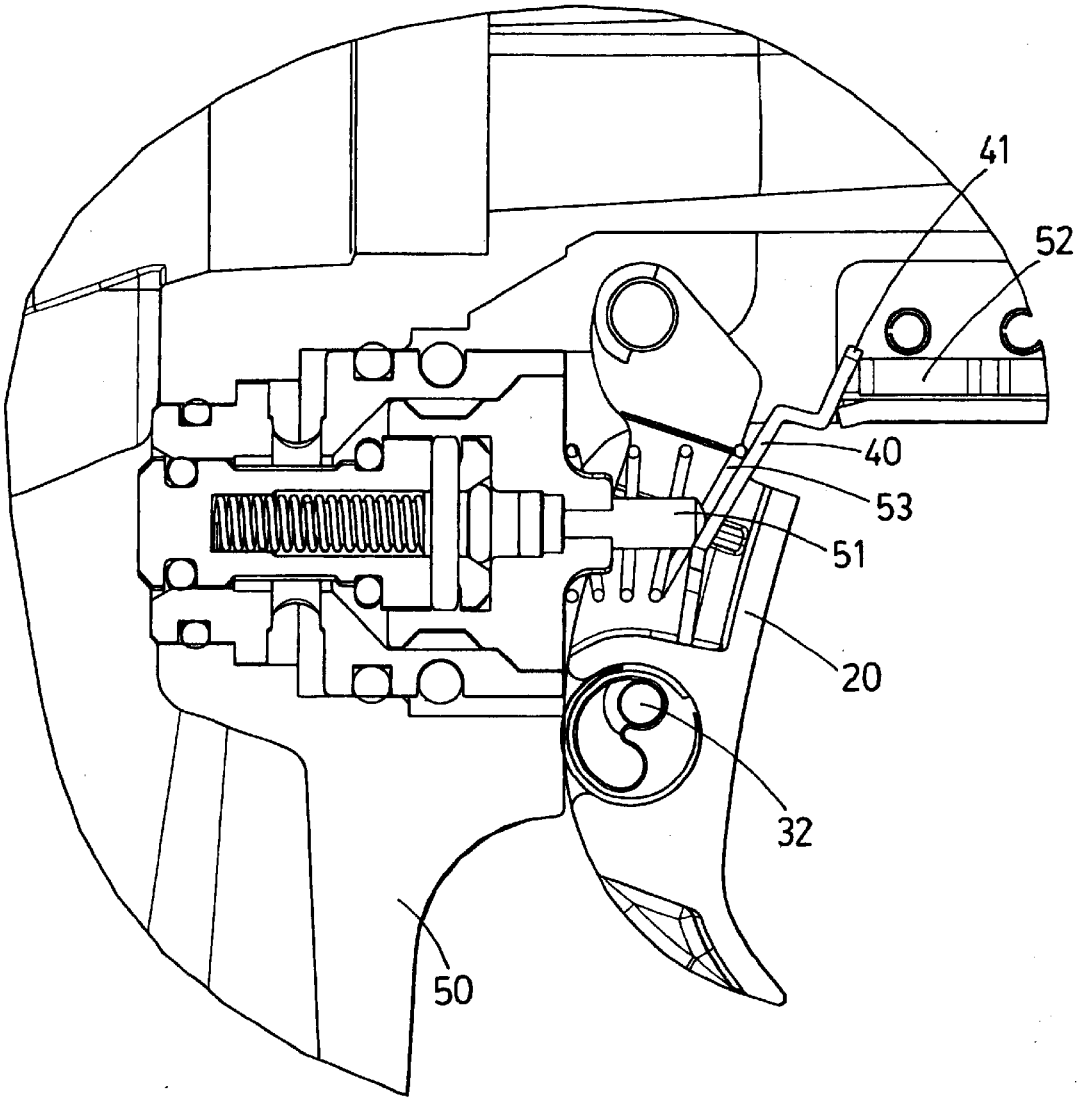
FIG. 16 shows the trigger is pulled when the activating member is raised to a high position before the safety plate is pushed.

As shown in FIG. 16, if the trigger 20 is pulled before the safety plate 52 is pushed, even if the activating plate 40 is located at the high position, the valve member 51 is not activated.

While we have shown and described the embodiment in accordance with the present invention, it should be clear to those skilled in the art that further embodiments may be made without departing from the scope of the present invention.

What is claimed is:

1. A trigger device for staplers, comprising:

a trigger adapted to be pivotably connected to a stapler body and an opening defined through the trigger;

a cam device rotatably engaged with the trigger;

an activating member inserted in the opening and connected to the cam device, a top plate extending at an angle from the activating member and the activating member being movable upward and downward by rotating the cam device, and a safety plate adapted to be slidably connected to the stapler body and a distal end of the safety plate located in correspondence with the opening of the trigger.

2. The device as claimed in claim 1 further comprising a first recess and a second recess defined in two opposite walls of the trigger and a passage defined in communication with the first recess and the second recess, a plate received in the first recess and a rod extending eccentrically from the plate, a knob rotatably received in the second recess and the rod extending through the passage and connected the knob eccentrically, the activating member connected to the rod.

3. The device as claimed in claim 2 further comprising a spring mounted to the rod and biased between the plate and an inside of the first recess.

* * * * *